United States Patent [19]

Cicin-Sain

[11] Patent Number: 4,742,628

[45] Date of Patent: May 10, 1988

[54] BALLAST RE-DISTRIBUTION UNIT ON A MACHINE TO SHAPE AND RE-DISTRIBUTE RAILWAY ROAD BEDS, AND A SHAPER AND RE-DISTRIBUTION MACHINE THUS EQUIPPED

[75] Inventor: Ivo Cicin-Sain, Bussigny-Laus., Switzerland

[73] Assignees: Daniele & C. Officine Mecc. SpA; ITI/CLM Impianti Technici Ind. SpA, both of Buttrio, Italy

[21] Appl. No.: 943,494

[22] Filed: Dec. 19, 1986

[30] Foreign Application Priority Data

Dec. 23, 1985 [IT] Italy ..... 83453 A/85

[51] Int. Cl.[4] ..... E02F 5/22

[52] U.S. Cl. ..... 37/105

[58] Field of Search ..... 37/104, 105; 171/16

[56] References Cited

U.S. PATENT DOCUMENTS

| | | | |
|---|---|---|---|
| 1,616,466 | 2/1927 | Pederson | 37/105 |
| 3,579,873 | 5/1971 | Kershaw | 37/105 |
| 4,227,324 | 10/1980 | Theurer | 37/104 |
| 4,249,325 | 2/1981 | Theurer | 37/104 |

*Primary Examiner*—Edgar S. Burr
*Assistant Examiner*—James Lisehora
*Attorney, Agent, or Firm*—Wegner & Bretschneider

[57] ABSTRACT

A metalling re-distribution system on a machine to shape and re-distribute railway road beds is disclosed having movable screens with terminal ploughs and cooperating with chutes that cover the rails, including, in a central position between the chutes, a bladed drum which has its axis substantially horizontal and parallel to the railway line, powered and capable of two-directional motion. The machine to shape and re-distribute railway road beds which employs the metalling re-distribution system is also disclosed.

7 Claims, 2 Drawing Sheets

BALLAST RE-DISTRIBUTION UNIT ON A MACHINE TO SHAPE AND RE-DISTRIBUTE RAILWAY ROAD BEDS, AND A SHAPER AND RE-DISTRIBUTION MACHINE THUS EQUIPPED

This invention concerns a ballast re-distribution unit on a machine to shape and re-distribute railway road beds. To be more exact, the invention concerns a metalling re-distribution unit to be fitted to self-propelled machines suited to the operations of dressing and shaping railway road beds.

The invention concerns also a shaping and re-distribution machine which employs such re-distribution unit.

The re-distribution unit according to the invention is suitable to carry out all types of re-distribution of the metalling, namely from the middle of the line to the outside, from the outside to the middle and from one side of the line to the other.

The invention enables all these tasks to be performed with very great operational flexibility and also permits the actuation systems to be simplified by providing a unit which is simple to construct and very strong and offers a considerable economy in construction and working.

Various machines are known in the art which are concerned with the operations of shaping and dressing railway road beds. For instance, a machine which is the subject of European patent application No. 0061227 is known and comprises on its lower side a system of ploughs to shape the road bed and also a conveyor belt located in a central position to lift the metalling.

Patent AT No. 359.112 concerns a machine to re-distribute road beds which is equipped with a system of movable ploughs capable of being displaced so as to form suitable channels to convey metalling below the machine itself. Lateral ploughs are positioned behind central ploughs and therefore it is impossible to re-distribute the ballast and dress the road bed in one and the same pass.

U.S. Pat. No. 3,579,873 (KERSHAW) discloses a machine equipped with a system of frontal ploughs and two adjustable lateral carriages to shape the road bed, and with a rear brush unit. The structure of this machine is extremely complicated, especially as regards the lateral carriages, which are equipped with disk ploughs and many actuators for positioning and adjustment purposes. The re-distribution force in this machine is wholly applied by the machine.

GB No. 1,006,639 discloses an equipment which serves to clean ballast from the rails and includes rotary means equipped with cleaning elements extending lengthwise.

U.S. Pat. No. 2,640,285 discloses equipment which serves to clean ballast from the sleepers and includes a plurality of rotary means which cover the railway roadbed transversely.

U.S. Pat. No. 3,543,297 discloses equipment that serves to clean ballast from the sleepers and comprises a plurality of beating and cleaning means. The cleaning means include a rotary chain with a lower positioning guide.

FR No. 1,386,754 discloses a combined equipment to arrange the ballast, clean the sleepers and beat the ballast, all these functions being carried out by independent devices.

EP No. 0164160 discloses a combined apparatus to clean ballast from the sleepers, arrange it and distribute it also along the lateral edges of the roadbed.

Other machines are known which are provided with shaper plough systems and rotatable re-distribution ploughs. One of such machines was built by Donelli and comprises a complicated system of rotatable ploughs which cooperate with chutes that cover the rails. These ploughs can be oriented in many directions, but it is impossible to carry out all the desired operations to re-distribute the ballast. For example, the ballast can be transferred from the middle of the line to the sides and viceversa or from the middle of the line to one side only and viceversa, but cannot be transferred, for instance, from one side of the line to the other.

A further machine to shape and re-distribute the road bed, which was constructed by PLASSER, comprises a central transfer carriage consisting of four screens positioned like a star and cooperating with known chutes that cover the rails. Adjustable ploughs are provided at the outer ends of the screens and are two in number on each side. A set of movable blades is arranged in the form of a star at the centre of the screens and enables such screens to be united in various manners, thus providing preferred paths for the metalling.

In this way the ballast can be transferred from the middle of the line to the outside or viceversa and also from the left side of the road bed to the right side or viceversa. This system entails the need to provide four screens, each bearing an outer plough, and also a system of blades at the centre of such screens. It also means that the force of transfer is entrusted only to the thrust of the machine.

This invention purposes to provide a ballast redistribution unit for machines which shape and re-distribute railway road beds, such unit being intended to overcome the drawbacks related to known machines.

The invention enables the road bed to be shaped perfectly and the ballast to be re-distributed even where the sleepers are of the recessed concrete or "bibloc" type.

According to the invention the re-distribution unit comprises a box-type carrying frame, which can be lifted by a hydraulic cylinder or other analogous means when the machine is to be moved to another area.

In a preferred embodiment such cylinder is a single-acting cylinder and the re-distribution unit is lowered by the effect of its own weight, thus settling down on supporting rollers onto the rails.

The possibility of a damaging upward thrust on the machine is thus obviated, for such a thrust might have occurred when the working unit touched the rails and road bed if the unit had been thrust downwards by hydraulic action and not by gravity.

Vertical guides are provided for the raising and lowering of the re-distribution unit.

According to the invention a screen is rotatably anchored at each side of the box frame and cooperates with the relative known chute that covers a rail. Such rotatable screen bears at its end a plough of a known type preferably comprising a portion of which the height or inclination can be adjusted to obtain the required outer profile of the road bed.

The re-distribution unit according to the invention comprises two rotatable screens, one on each side of the machine, each screen bearing a plough at its end.

A bladed drum having a substantially horizontal axis parallel to the rails is located in a central position between the rotatable screens according to the invention. Such bladed drum can be adjusted vertically independently of the box frame; the desired central profile of the road bed can be obtained in this way.

Rotation of the bladed drum in one direction or the other enables the ballast to be transferred from one side of the line or the other, as required, in coordination with the positions applied to the screens and relative ploughs.

The working zone of the bladed drum is fully enclosed at its rear by the box frame and by two wings or stationary screens of such frame, such stationary screens cooperating with the lateral chutes that cover the rails.

Loss of ballast is obviated in this way, and the metalling is conveyed in an excellent manner.

The provision of a rotary drum to move the metalling from the right to the left and viceversa has the effect that only a part of the force of transfer of the ballast uses the motive thrust of the machine, the remaining part of such force being entrusted to the positive action of the drum.

The combination of the positioning of the movable screens with the relative ploughs and of the rotation of the drum, together with the vertical adjustment of the drum, enables any required method of re-distribution of the metalling to be obtained, that is to say, the ballast can be transferred easily from the middle of the line to the outside, and the quantity of ballast to be moved to the right or left can be adjusted by the direction of rotation of the drum; the profile of the road bed can also be adjusted by means of the screens and ploughs. By adjusting the height of the bladed drum it is also possible to leave more or less ballast in the middle of the line.

Likewise, the ballast can be transferred from the sides of the line to the middle by arranging the screens and relative ploughs in their forward position and by raising the bladed drum enough to leave the required thickness of ballast in the middle of the line.

Rotation of the drum may perhaps be able to rectify any lack of symmetry of the ballast in the middle of the line.

If ballast is to be transferred from one side of the line to the other, one of the movable screens will be arranged in its forward position while the other movable screen will be in its backward position, and the drum will be rotated in the appropriate direction to facilitate such transfer.

In this case too the height pre-set for the bladed drum adjusts the quantity of ballast left in the middle of the line to the level required.

The great working flexibility of this invention seems clear from the above and will be even more evident from the detailed description which follows.

This invention is therefore embodied with a ballast redistribution unit on a machine to shape and re-distribute railway road beds, which unit comprises movable screens having terminal ploughs and cooperating with chutes that cover the rails, the unit being characterized in that it includes in a central position between such chutes a bladed drum which has its axis substantially horizontal and parallel to the railway line and is powered, being capable of two-directional motion.

The invention is embodied also with a machine to shape and re-distribute railway road beds, which is characterized in that it employs such ballast re-distribution unit.

We shall now describe a preferred embodiment of the invention as a non-restrictive example with the help of the attached figures, in which.

Figure 4A:
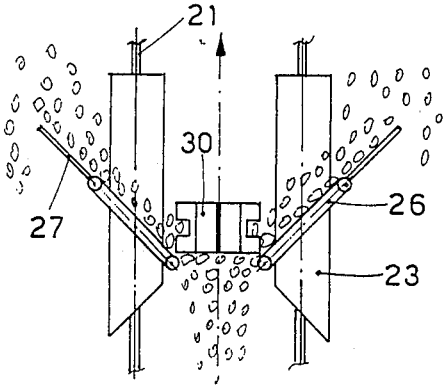
Figure 4B:
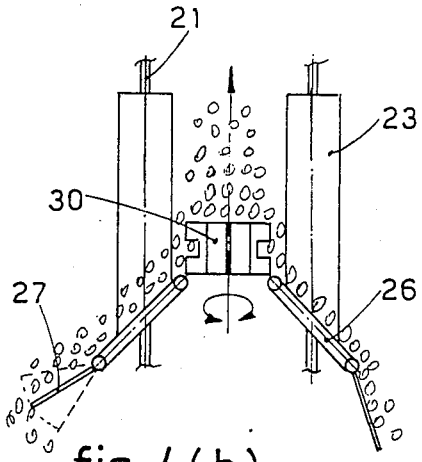
Figure 4C:
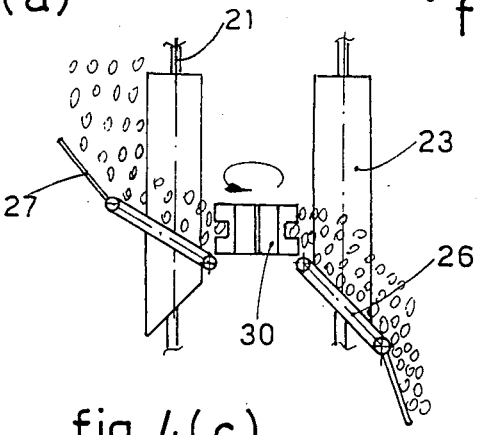

FIG. 4*a*, 4*b* and 4*c* show possible methods of working of the device in a diagrammatic form.

Figure 1:
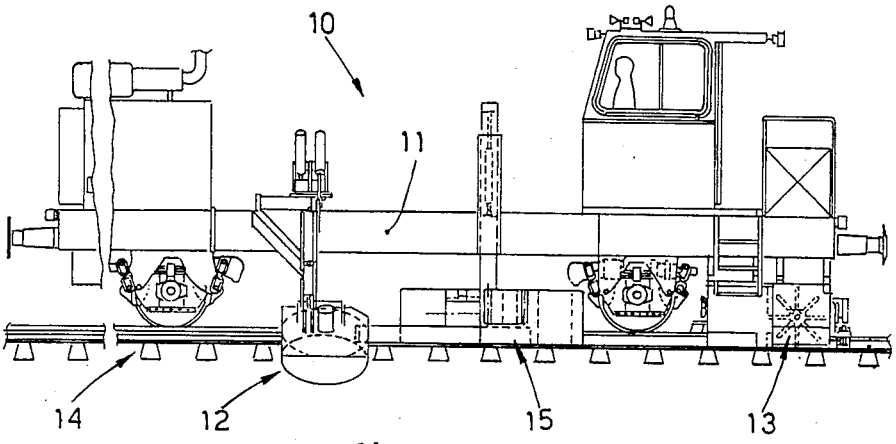
FIG. 1 is a diagrammatic view of a shaping and re-distribution machine to which the invention is fitted.

In FIG. 1 a shaping and re-distribution machine 10 for railway road beds is located on a segment of railway line 14 and comprises a frame 11, which in this example is of a single beam type and bears in a known manner a driver's cab and also a motor unit at its front.

The frame 11 bears also a lateral shaping unit 12, which in this example comprises shaping drums, one on each side. A brush unit 13 is located at the rear.

A ballast re-distribution unit 15 according to the invention is included in a central position.

Figure 2:
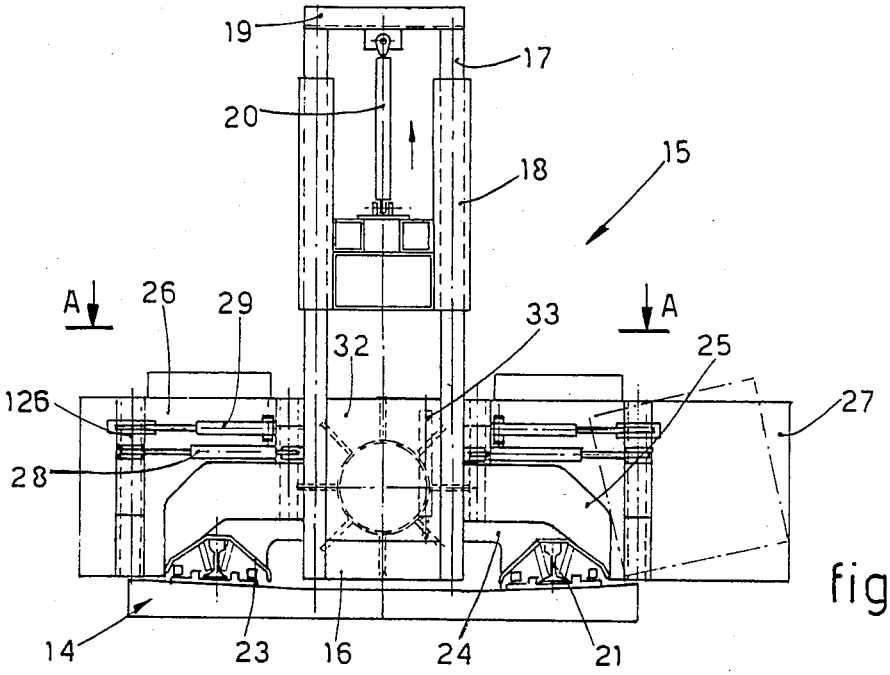
FIG. 2 is a view from the rear of the re-distribution unit according to the invention.
Figure 3:
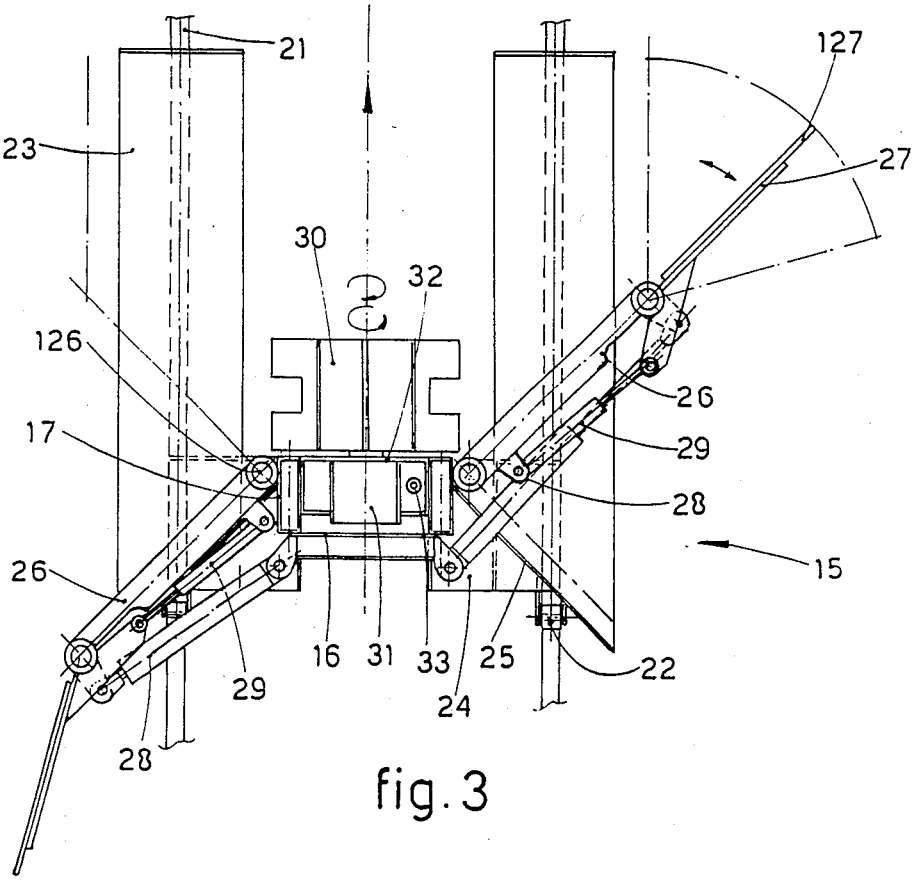
FIG. 3 is a plan view along A—A of FIG. 2.

In FIGS. 2 and 3 the re-distribution unit 15 comprises a central box frame 16 with two vertical uprights 17, which slide within guides 18 solidly fixed to the single beam frame 11 of the machine. Such vertical uprights 17 are connected together at their support end by a crosspiece 19.

A single-acting hydraulic cylinder 20 is fixed at one end to the frame 11 of the machine 10 and at its other end to the crosspiece 19. When pressure is applied to the cylinder 20, the whole re-distribution unit 15 is lifted and is guided in the guides 18.

When pressure is withdrawn from the cylinder 20, the redistribution unit 15 is lowered by its own weight and rests on support and alignment rollers 22 on the rails 21. The box frame 16 of the unit supports chutes 23 by means of lateral extensions 24.

Two stationary screens 25 are secured to the ends of the chutes 23 and have the task of guiding the metalling over the chutes.

The box frame 16 and the screens 25, which are inclined backwards, enclose fully the zone between the chutes, as can be seen in the plan view of FIG. 3.

At the sides of the box frame 16, movable screens 26, one on each side, are pivoted at 126 and bear, at their outer end, ploughs 27 anchored rotatably to the movable screens 26.

The ploughs 27 comprise in a known manner an adjustable portion 127 able to alter the shape given to the road bed at the sides of the line.

On each side of the box frame 16 of the unit a first hydraulic cylinder 28 serves to position the movable screen 26, whereas a second hydraulic cylinder 29 serves to position the plough 27 in relation to its movable screen 26.

A drum 30 comprising blades and having its axis substantially horizontal and parallel to the railway line is positioned centrally between the chutes 23 and is driven by a hydraulic motor 31 located within a box-type casing 32.

The height of the casing 32 in relation to the box frame 16 of the unit can be adjusted by a hydraulic cylinder 33. It is possible in this way to regulate the height of the bladed drum 30 from the road bed independently of the position of the unit 15 resting on the rails.

It is therefore possible to regulate the height of the profile of the road bed in the middle of the railway line and also the action of the rotary drum on the ballast.

In particular, this capability of vertical regulation is useful where the sleepers are of a recessed or "bibloc"

type, and enables the scraping action of the bladed drum to be adapted to the profile of the sleeper.

The drum 30 is positioned further forward than the pivots 126 of the movable screens 26, such pivots 126 being located in the immediate neighbourhood of the drum 30.

In this way there is excellent cooperation between the movable screens 26 and drum 30 in re-distributing the ballast.

FIGS. 4*a*, 4*b* and 4*c* show various examples of the working of the re-distribution unit 15 according to the invention.

In FIG. 4*a* the movable screens 26 and ploughs 27 are in their fully forward position. Ballast 33 is therefore scraped from the sides of the railway line and sent to the middle.

The drum 30 is suitably lifted to obtain the required profile in the middle of the line 14. The drum 30 may possibly be rotated in one direction or the other to rectify any lack of symmetry in the distribution of the ballast in the middle of the line.

By adjusting the position of the screens 26 and ploughs 27 it is possible to regulate the quantity of ballast scraped from one side or the other respectively of the line 14.

FIG. 4*b* shows the ballast being transferred from the middle to the outside of the line. By rotating the drum 30 in one direction or the other, the quantity of ballast transferred to the right or left respectively of the line 14 is adjusted.

Moreover, by regulating the positions of the screens 26 and ploughs 27 it is possible to adjust the distance of the distribution of ballast outside the line 14.

By adjusting the height of the drum 30, it is possible to regulate the quantity of ballast which is to remain in the middle of the railway line.

FIG. 4*c* shows ballast being transferred from one side of the line to the other, in this case from the left of the line 14 to the right. In this example one movable screen 26, on the left in the figure, is in its fully forward position, whereas the movable screen 26 on the right is in its fully backward position.

The drum here is rotated in a direction to send the ballast from the left to the right.

In this case too, by regulating the height of the drum 30 it is possible to regulate the quantity of ballast to be left in the middle of the line 14.

By regulating the ploughs 27 it is possible to change the quantity of ballast scraped at one side of the line and also the distribution of the ballast discharged on the other side of the line.

An examination of FIGS. 4*a*, 4*b* and 4*c* shows clearly the great working flexibility made possible by the invention.

While the invention has been particularly shown and described in reference to preferred embodiments thereof, it will be understood by those skilled in the art that changes in form and details may be made therein without departing from the spirit and scope of the invention.

I claim:

1. A ballast re-distribution system for use on a machine to shape and re-distribute railway road beds, comprising:

movable screens having terminal ploughs, and chutes for covering railway rails, said movable screens cooperating with said chutes; and a bladed drum being in a central position of said system between said chutes having an axis of rotation, said axis being substantially horizontal and parallel to the railway line, said bladed drum being powered and being capable of selective rotation in either one of at least two directions, said movable screens and said bladed drum cooperating to re-distribute ballast on the sides of and between said railway rails.

2. The ballast re-distribution system as in claim 1, wherein at least one movable screen is positioned on each side of said system, wherein said at least one movable screen has a rotation pivot in the neighborhood of the periphery of said bladed drum.

3. The ballast re-distribution system as in claim 1, wherein said bladed drum is positioned forward further than said pivots of said movable screens.

4. The ballast re-distribution system as in claim 1, further comprising a frame which supports said movable screens and said chutes.

5. The ballast re-distribution system as in claim 1, wherein the height of said bladed drum can be independently regulated.

6. The ballast re-distribution system as in claim 4, wherein said frame comprises vertical uprights cooperating with guides solidly fixed to another frame of said shaping and redistribution system.

7. The ballast re-distribution system as in claim 4, further comprising a single-acting hydraulic cylinder to cause ascent of said re-distribution system which is lowered by the force of gravity when the pressure in said cylinder is discharged.

* * * * *

UNITED STATES PATENT AND TRADEMARK OFFICE

CERTIFICATE OF CORRECTION

PATENT NO. : 4,742,628

DATED : May 10, 1988

INVENTOR(S) : Ivo CICIN-SAIN

It is certified that error appears in the above-identified patent and that said Letters Patent is hereby corrected as shown below:

On the cover page, change:

"[73] Assignees: Daniele & C. Officine Mecc. SpA; ITI/CLM Impianti Technici Ind. SpA, both of Buttrio, Italy" to --[73] Assignees Danieli & C. Officine Tecnici Meccaniche SpA; ITI/CLM Impianti Technici Industriali SpA, both of Buttrio, Italy--

Signed and Sealed this

Thirty-first Day of January, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,742,628

DATED : May 10, 1988

INVENTOR(S) : Ivo CICIN-SAIN

It is certified that error appears in the above-identified patent and that said Letters Patent is hereby corrected as shown below:

On the cover page, change:

"[73] Assignees: Daniele & C. Officine Mecc. SpA; ITI/CLM Impianti Technici Ind. SpA, both of Buttrio, Italy" to --[73] Assignees Daniele & C. Officine Meccaniche SpA; ITI/CLM Impianti Technici Industriali SpA, both of Buttrio, Italy--

This certificate supercedes Certificate of Correction issued January 31, 1989.

Signed and Sealed this

Twenty-third Day of May, 1989

*Attest:*

*Attesting Officer*

DONALD J. QUIGG

*Commissioner of Patents and Trademarks*